US012474137B2

(12) United States Patent
Palu et al.

(10) Patent No.: US 12,474,137 B2
(45) Date of Patent: Nov. 18, 2025

(54) SUPPRESSOR BRAKE

(71) Applicant: Thunder Beast Arms Corporation, Cheyenne, WY (US)

(72) Inventors: Kurtis Palu, Cheyenne, WY (US); Sutherland Detweiler, Cheyenne, WY (US)

(73) Assignee: THUNDER BEAST ARMS CORPORATION, Cheyenne, WY (US)

( * ) Notice: Subject to any disclaimer, the term of this patent is extended or adjusted under 35 U.S.C. 154(b) by 153 days.

(21) Appl. No.: 18/462,971

(22) Filed: Sep. 7, 2023

(65) Prior Publication Data

US 2025/0085074 A1 Mar. 13, 2025

(51) Int. Cl.
*F41A 21/36* (2006.01)
*F41A 21/30* (2006.01)

(52) U.S. Cl.
CPC ..... *F41A 21/36* (2013.01); *F41A 21/30* (2013.01)

(58) Field of Classification Search
CPC ..... F41A 21/36; F41A 21/38; F41A 21/32; F41A 21/30
See application file for complete search history.

(56) References Cited

U.S. PATENT DOCUMENTS 9,513,078 B1 * 12/2016 Fulton ..... F41A 21/325
9,739,560 B1 * 8/2017 Salvador ..... F41A 21/34
9,921,021 B1 * 3/2018 Graham, II ..... F41A 21/325
10,082,355 B2 * 9/2018 Addis ..... F41A 21/36
10,480,888 B2 * 11/2019 Barrett ..... F41A 21/28
10,612,878 B1 * 4/2020 Salvador ..... F41A 21/325
11,262,150 B1 * 3/2022 VanFossan ..... F41A 21/36
11,486,670 B1 * 11/2022 Lovas ..... F41A 21/325
2017/0205176 A1 * 7/2017 Whitson ..... F41A 21/325
2018/0017352 A1 * 1/2018 Addis ..... F41A 21/36
2021/0041200 A1 * 2/2021 Kras ..... F41A 21/30
2021/0404760 A1 * 12/2021 Hipp ..... F41A 21/36
2022/0107153 A1 * 4/2022 Quinn ..... F41A 21/36
2022/0260332 A1 * 8/2022 Grob ..... F41A 21/30
2024/0077272 A1 * 3/2024 Lowell ..... F41A 21/36
2024/0328738 A1 * 10/2024 Bundy ..... F41A 21/325

OTHER PUBLICATIONS

The Firearm Blog; Eric B; Maverick Recoil Suppression System from Area 419; Nov. 25, 2019; https://www.thefirearmblog.com/blog/2019/11/25/maverick-recoil-suppression-system-from-area-419/ (Year: 2019).*

(Continued)

*Primary Examiner* — Joshua E Freeman
(74) *Attorney, Agent, or Firm* — Quarles & Brady LLP

(57) ABSTRACT

A system for a firearm having a timeable brake and a suppressor. The brake comprises a brake body, a first taper, and a collar configured to rotate independently of the brake body. The suppressor comprises a second taper. When the brake body is oriented in a selected orientation with respect to the suppressor, a force is applied to wedge the first taper into the second taper and rotationally lock the selected orientation of the brake body. Rotation of the collar to a locked position then secures the brake body to the suppressor.

18 Claims, 7 Drawing Sheets

(56) References Cited

OTHER PUBLICATIONS

Recoil; Dave Merrill; Area 419 Maverick Silencer; Nov. 15, 2019; https://www.recoilweb.com/first-look-area-419-maverick-silencer-154326.html (Year: 2019).*
Area 419; Getting to Know Your Maverick; Mar. 14, 2020; https://www.youtube.com/watch?v=RIPtprBuxHQ&t=320s (Year: 2020).*
Deer and Deer Hunting; Silencerco Suppressors Prove that Silence is Golden; Jun. 13, 2016 (Year: 2016).*
Area 419; Hellfire Suppressor Mounts; Oct. 28, 2017; https://www.youtube.com/watch?v=EiwMB9bHM0E&t=133s (Year: 2017).*

* cited by examiner

114

700

SUPPRESSOR BRAKE

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to a brake and a suppressor for a firearm, and more particularly, to a timeable brake configured to be coupled to a suppressor for a firearm.

BACKGROUND

In order to fire a projectile, a firearm utilizes an ignited propellant to create a high-pressure pulse of hot gases behind the projectile to force the projectile down the barrel of the firearm. When the high-pressure gases exit the barrel of the firearm, they generate a loud noise, commonly referred to as a "muzzle blast." Noise suppressors are commonly used with firearms, such as rifles and handguns, to reduce muzzle blast. To reduce muzzle blast, suppressors couple to an end of the firearm barrel and allow the high-pressure gases to expand, and thereby dissipate pressure, before exiting the firearm. By allowing the pressure behind the projectile to dissipate before exiting the firearm, a firearm suppressor can significantly reduce muzzle blast.

Additionally, as the high-pressure pulse of hot gases exit the firearm, the firearm recoils from the force of the hot gases. Brakes are commonly used with firearms, such as rifles and handguns, to reduce a recoil of the firearm. To reduce the recoil of the firearm, brakes typically redirect or counter at least some of the force from the hot gases by allowing at least some of the hot gases to exit through one or more ports of the brake. In many cases, it is desirable to use a brake that is timeable (e.g., able to be rotationally aligned in a particular orientation). Timeable brakes are more efficient at reducing recoil because the timeable brakes can redirect the force from the hot gases in a particular direction to counteract the recoil.

Thus, it is desirable to have a firearm system having a suppressor to reduce muzzle blast and a timeable brake to reduce recoil of the firearm. Hence, there is a need to for a firearm system capable of coupling a timeable brake to a suppressor.

SUMMARY

Some embodiments of the disclosure provide a system for a firearm. In an aspect, a system for a firearm includes a brake and a suppressor. The brake has a brake body having a proximal end. The proximal end includes an outer surface having a first taper. The brake further includes a collar connected to the proximal end of the brake body, the collar configured to independently rotate around the proximal end of the brake body, and the collar having an inner surface having one or more inner threads. The suppressor has a suppressor body having a distal end. The distal end includes an aperture, an inner surface having a second taper, and an outer surface having one or more outer threads. The aperture of the distal end of the suppressor is configured to receive the proximal end of the brake and the first taper is configured receive the second taper. The one or more inner threads of the collar are configured to engage with the one or more outer threads of the suppressor. When the brake body is oriented in a selected orientation with respect to the suppressor body, rotation of the collar to a locked position secures the brake body to the suppressor body.

In various cases, an angle of at least one of the first taper or the second taper is about 20 degrees or less. In some instances, when the brake body is oriented in a selected orientation, the brake body is configured to receive a force in toward a proximal end of the suppressor body opposite the distal end of the suppressor body to wedge at least a portion of the second taper and the first taper together to prevent rotation of the brake body with respect to the suppressor body. When at least a portion of the first taper is wedged against at least a portion of the second taper and when the collar is in a locked position, the first taper and second taper create a seal.

In some embodiments, at least one of the inner surface having the first taper or the outer surface having the second taper comprises a conical shape or a frustoconical shape. In some cases, at least one of the inner surface having the first taper or the outer surface having the second taper are smooth.

In various instances, when the collar is in the locked position, the selected orientation of the brake is selected to reduce a recoil of the system when a proximal end of the suppressor body opposite the distal end of the suppressor body is attached to the firearm. The brake can be a timeable brake.

In some cases, the brake further includes a first groove on the outer surface of the proximal end of the brake body; a ring engaged with the first groove on the outer surface of the proximal end of the brake body; and a second groove on the inner surface of the collar. When the collar is in an unlocked position the ring is configured to float within the second groove, and, when the collar is in the locked position, an upper surface of the second groove is configured to engage with the ring to prevent the collar from rotating.

In various embodiments, the brake further includes one or more first ports on a first side of the brake body and one or more second ports on a second side opposite the first side of the brake body. The suppressor can further include a baffle system at least partially surrounded by the suppressor body, the baffle system comprising one or more baffles.

In another aspect, a brake for a firearm includes a brake body having a proximal end. The proximal end includes an outer surface having a first taper configured to engage with a second taper of a distal end of a suppressor or an adapter. The brake further includes a collar connected to the proximal end of the brake body, the collar configured to independently rotate around the proximal end of the brake body, and the collar having an inner surface having one or more inner threads. The one or more inner threads of the collar are configured to engage with one or more outer threads of at least one of the suppressor or the adapter. When the brake body is oriented in a selected orientation with respect to the suppressor or the adapter, rotation of the collar to a locked position secures the brake body to the suppressor or the adapter.

In some embodiments, an angle the first taper is about 20 degrees or less. The outer surface having the second taper comprises a conical shape or a frustoconical shape. In some cases, the outer surface having the second taper is smooth.

In various instances, the brake can be a timeable brake.

In some cases, the brake further includes a first groove on the outer surface of the proximal end of the brake body; a ring engaged with the first groove on the outer surface of the proximal end of the brake body; and a second groove on the inner surface of the collar. When the collar is in an unlocked position the ring is configured to float within the second groove, and, when the collar is in the locked position, an upper surface of the second groove is configured to engage with the ring to prevent the collar from rotating.

In various embodiments, the brake further includes one or more first ports on a first side of the brake body and one or more second ports on a second side opposite the first side of the brake body.

In yet another aspect, a method of manufacturing a system for a firearm includes forming a brake. The brake has a brake body having a proximal end. The proximal end includes an outer surface having a first taper. The brake further includes a collar connected to the proximal end of the brake body, the collar configured to independently rotate around the proximal end of the brake body, and the collar having an inner surface having one or more inner threads. The suppressor has a suppressor body having a distal end. The distal end includes an aperture, an inner surface having a second taper, and an outer surface having one or more outer threads. The aperture of the distal end of the suppressor is configured to receive the proximal end of the brake and the first taper is configured receive the second taper. The one or more inner threads of the collar are configured to engage with the one or more outer threads of the suppressor. When the brake body is oriented in a selected orientation with respect to the suppressor body, rotation of the collar to a locked position secures the brake body to the suppressor body.

The method can further include forming a suppressor. The suppressor has a suppressor body having a distal end. The distal end includes an aperture, an inner surface having a second taper, and an outer surface having one or more outer threads.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

DETAILED DESCRIPTION

Figure 1:
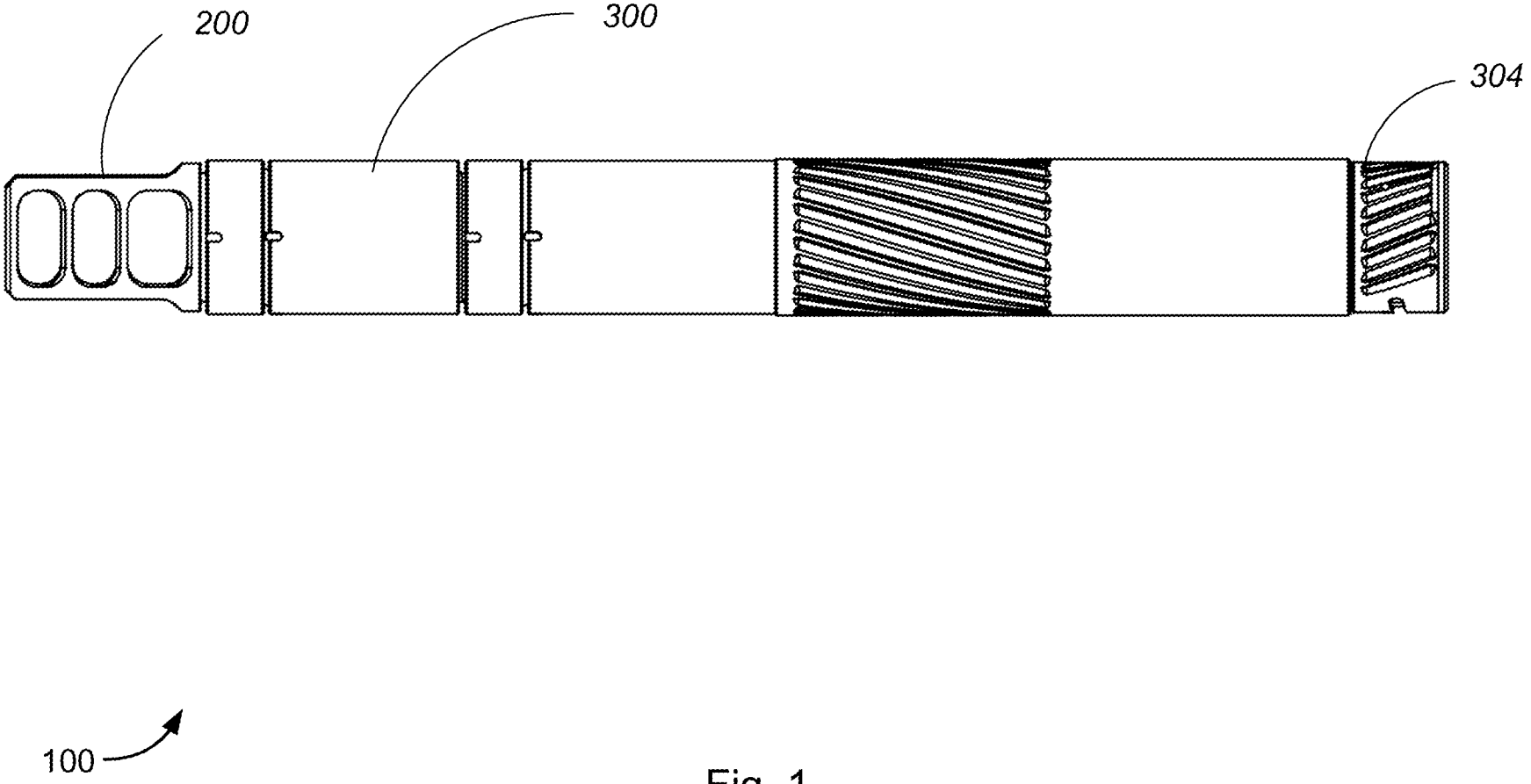
FIG. 1 is a side elevation view of one embodiment of a system of a firearm having a brake and a suppressor as disclosed herein.

While various aspects and features of certain embodiments have been summarized above, the following detailed description illustrates a few exemplary embodiments in further detail to enable one of skill in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the described inventions may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application, the use of the singular includes the plural unless specifically stated otherwise, and use of the terms "and" and "or" means "and/or" unless otherwise indicated. Moreover, the use of the term "including," as well as other forms, such as "includes," "included," "comprising," or "having" should be considered non-exclusive. Also, terms such as "element" or "component" encompass both elements and components comprising one unit and elements and components that comprise more than one unit, unless specifically stated otherwise. Additionally, unless specified or limited otherwise, the terms "mounted," "connected," "supported," "attached,' and "coupled" and variations thereof are used broadly and encompass both direct and indirect mountings, connections, supports, and couplings. Further, "connected" and "coupled" are not restricted to physical or mechanical connections or couplings.

As used herein, unless otherwise defined or limited, directional terms are used for convenience of reference for discussion of particular figures or examples. For example, references to downward, lower, distal, or other directions or top, upper, proximal, or other positions may be used to discuss aspects of a particular example or figure, but do not necessarily require similar orientation or geometry in all installations or configurations. Additionally, unless otherwise specified or limited, the terms "about" and "approximately," as used herein with respect to a reference value or ratio, refer to variations from the reference value or ratio of ±15% or less (e.g., ±10%, ±5%, etc.), inclusive of the endpoints of the range.

Some of the discussion below describes a brake and/or suppressor for use with a firearm. The context and particulars of this discussion are presented as examples only. For example, embodiments of the disclosure can be configured in various ways, including with other shapes and arrangements of elements than are expressly described or illustrated. Similarly, embodiments of the disclosure can be used with different firearms other than those expressly illustrated or described herein.

Timeable (e.g., able to be rotationally aligned in a particular orientation or position) brakes are often desired to reduce a recoil experienced by a firearm as one or more hot gases exit the barrel of the firearm. Additionally, suppressors are often desired to reduce muzzle blast. However, because timeable brakes need to be mounted in a particular orientation or position to effectively reduce a recoil of the firearm, it is difficult to attach a timeable brake to a suppressor in a particular orientation to effectively reduce both recoil of the firearm and muzzle blast.

Embodiments of the disclosure can address these or other issues. For example, in some embodiments, a timeable brake is provided that can be attached to the suppressor in any orientation or position. This can be achieved by providing a collar on the timeable brake that is able to rotate independently of a body of the brake. Additionally, the brake and/or the suppressor can each have a tapered surface to guide the brake into an aperture of the suppressor and orient or position the brake in any desired orientation or position relative to a body of the suppressor.

We now turn to the embodiments as illustrated by the drawings. FIGS. 1-7 illustrate some of the features of a timeable brake and suppressor for a firearm, as referred to above. The apparatuses or systems illustrated by FIGS. 1-7, in some cases, may refer to examples of different embodiments that include various components, which can be considered alternatives or which can be used in conjunction with one another in the various embodiments. The description of the illustrated apparatuses or systems shown in FIGS. 1-7 is provided for purposes of illustration and should not be considered to limit the scope of the different embodiments.

FIG. 1 illustrates a side elevation view of one embodiment of a system 100 having a brake 200 and a suppressor 300, in accordance with various embodiments. The brake 200 is removably coupled to the suppressor 300. This removable coupling will be described further below.

Figure 2:
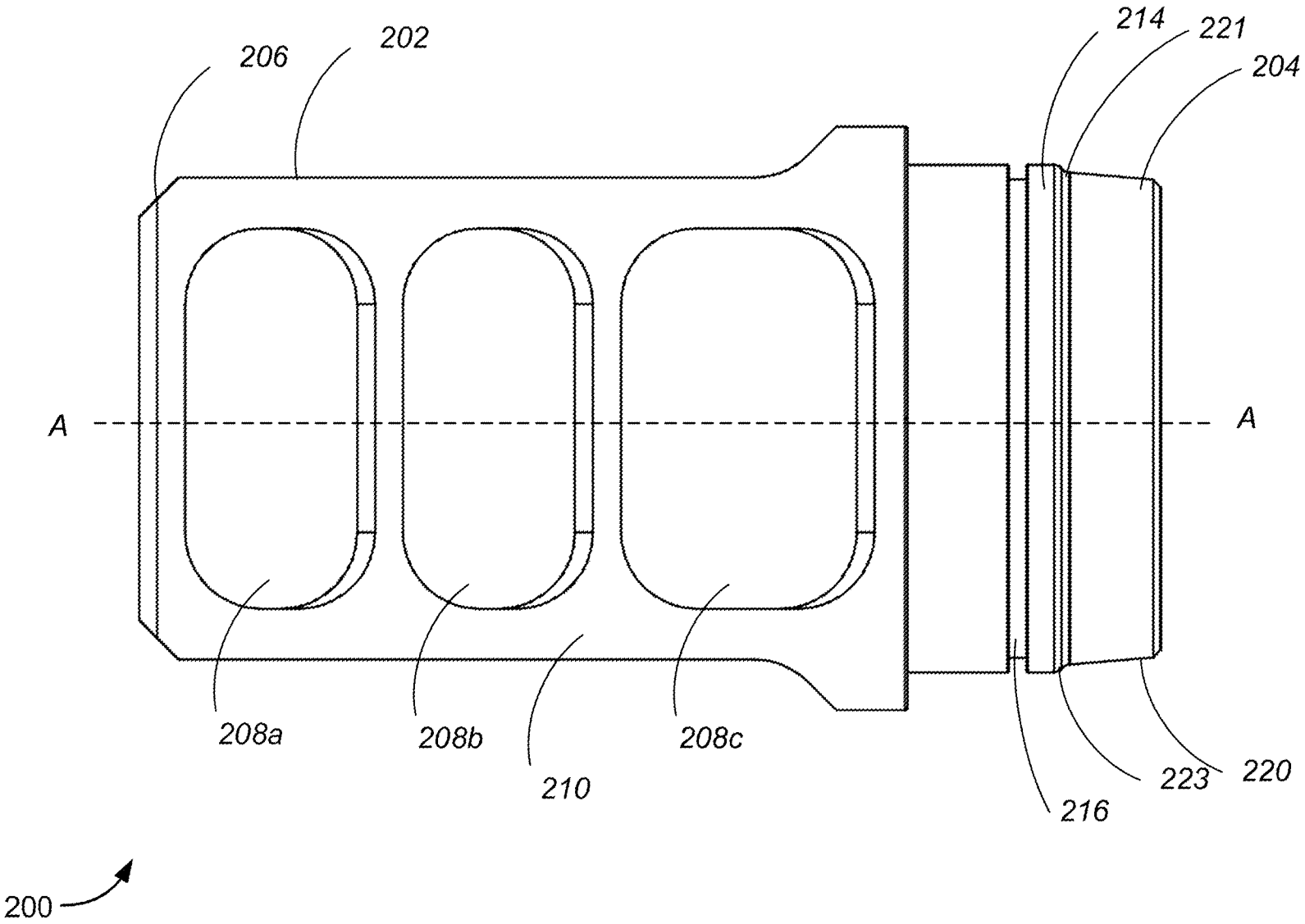
FIG. 2 is a side elevation view of the brake of FIG. 1 as disclosed herein.
Figure 3:
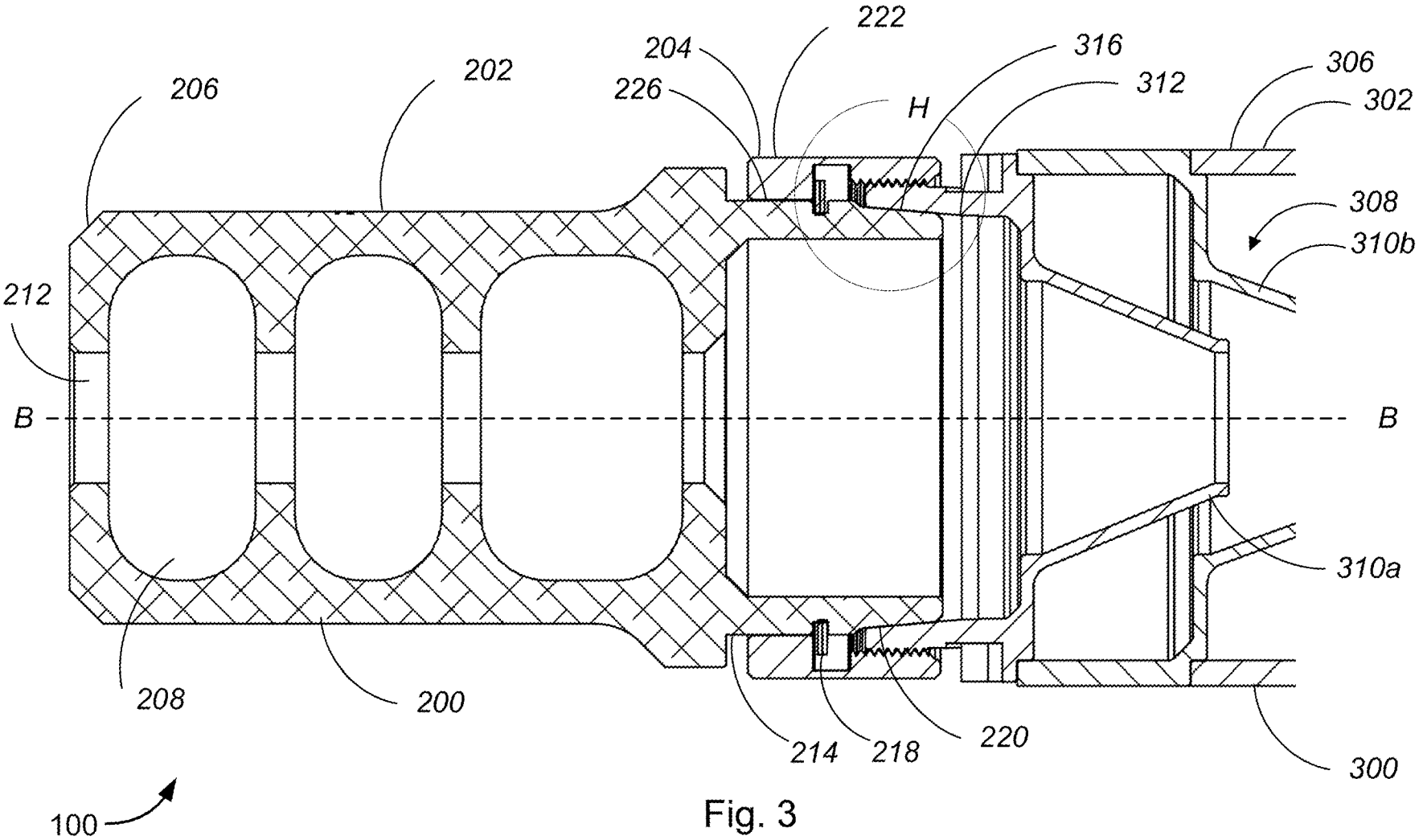
FIG. 3 is a side elevation cross-sectional view of one embodiment of the system of the firearm of FIG. 1 as disclosed herein, with the cross section taken along a front to back centerline plane of FIG. 1.
Figure 4:
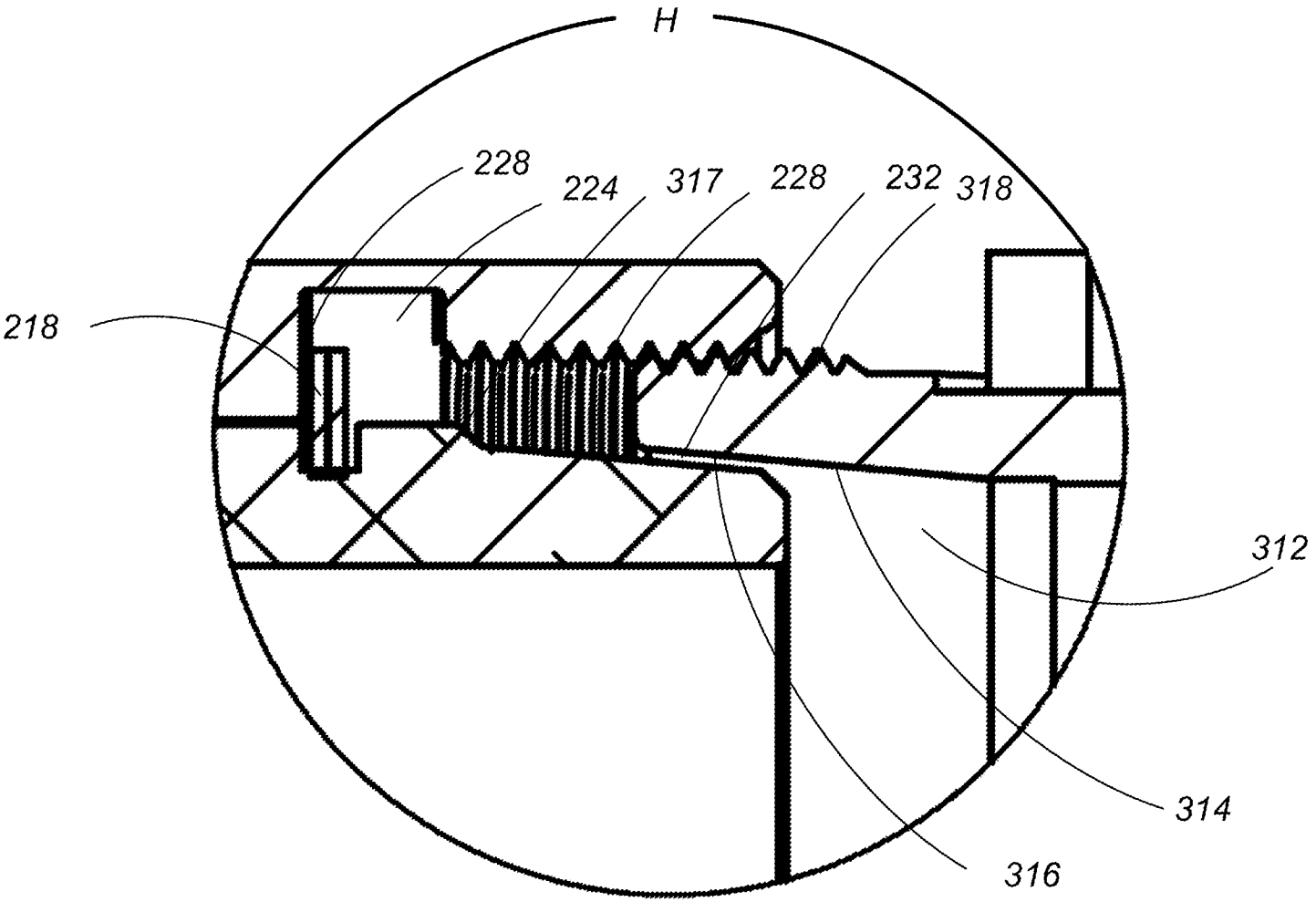
FIG. 4 is a side elevation cross sectional view of circle H of FIG. 3 with the brake in an unlocked position.
Figure 5:
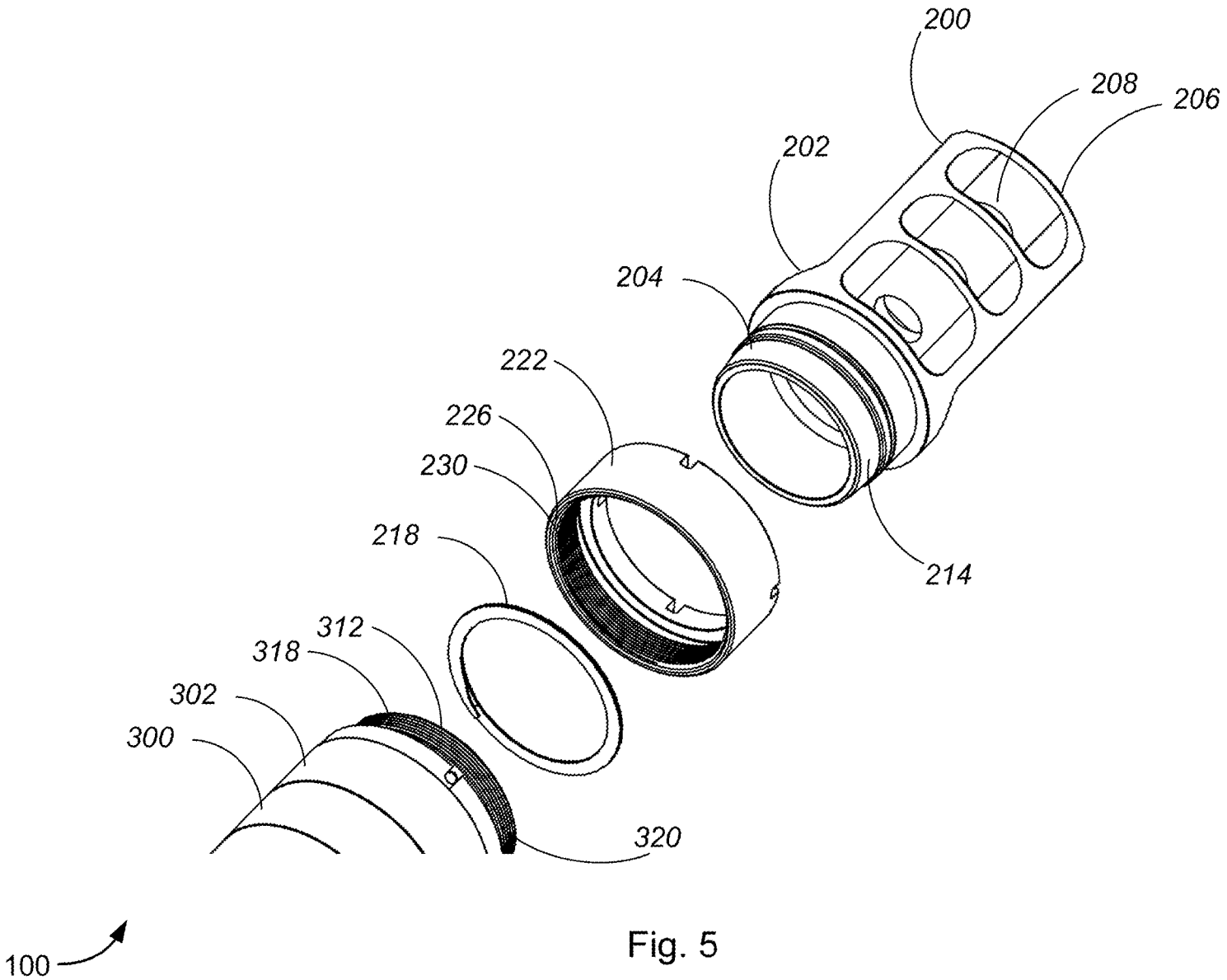
FIG. 5 is a perspective exploded view of the firearm system of FIG. 1 as disclosed herein.

FIG. 2 represents a side elevation view of the brake 200, in accordance with various embodiments. FIG. 3 illustrates a cross-sectional view of firearm system 100 having the brake 200 and the suppressor 300, with the cross-section taken along a front to back centerline plane of FIG. 1. FIG. 5 illustrates an exploded perspective view of the firearm system 100.

The brake 200 is an exemplary brake for a firearm and is not intended to limit the configuration of a brake that can be used with the proposed system 100. The brake 200 might have many different configurations from the one shown in FIGS. 1, 2, 3, and 5. The firearm that the brake 200 attaches to might include, but is not limited to, a rifle, handgun, automatic firearm, semiautomatic firearm, or the like.

The brake 200 includes a brake body 202 having a proximal end 204 and a distal end 206 opposite the proximal end 204. As used in this detailed description, the term "proximal" is used to refer to the end of the component or element closest to the barrel of the firearm and the term "distal" is used to refer to the end of the component or element farthest from the barrel of the firearm. In some cases, the proximal end 204 of the brake body 202 is configured to attach to a suppressor 300 (e.g., a distal end 306 of the suppressor 300). In other cases, the proximal end 204 of the brake body 202 is configured to attach to an adapter 400 (e.g., a distal end 406 of the adapter 400). The distal end 206 is configured to allow a projectile to exit the brake body 202. The brake body 202 of the brake 200 can be cylindrical, square-shaped, conical, rectangular, and/or the like.

In some embodiments, in order to reduce the recoil of a firearm, the brake 200 includes one or more ports 208. In the case of FIGS. 2 and 5, the brake has three ports (e.g., ports 208*a*, 208*b*, 208*c*, and/or the like) on a first side 210 of the brake body 202 and three ports (not shown) on a second side (not shown) opposite the first side 210 of the brake body 202. In some cases, the brake body 202 can have more or less ports and/or the one or more ports can be arranged on the brake body 202 in a different orientation or position than the orientation and position shown in FIGS. 2, 3, and 5. The one or more ports 208 provide one or more additional openings (e.g., in addition to an opening 212 in a distal end 206 of the brake) from which gases can be expelled from the brake body 202. By expelling gases from the one or more ports 208 in addition to the opening 212 of the distal end 206 of the brake body 202, a recoil of the firearm can be reduced.

In some cases, the brake 200 is a timeable brake. In other words, the brake 200 is a brake that must be able to be rotationally aligned in a particular orientation, position, or direction in order to reduce the recoil of a firearm. In a non-limiting example, the one or more ports 208 can be oriented such that gases expelled from the one or more ports 208 are expelled to one or more sides relative to a barrel of the firearm versus up or down relative to a barrel of a firearm.

In various embodiments, the brake 200 further includes an outer surface 214 at the proximal end 204 of the brake body 202. The outer surface 214 includes a first groove 216. The first groove 216 is configured to receive or engage with a ring 218 (e.g., a circlet, a snap ring, or the like). In some cases, the ring 218 is press fit into the first groove 216 and is rotationally locked into the first groove 216. In some cases, a width of the first groove 216 is about a same width of the ring 218 such that the ring 218 is press fit into the first groove 216 and is rotationally locked into the first groove 216.

In some cases, the outer surface 214 includes a taper 220 (e.g., first taper 220). The first taper 220 might be angled at about 20 degrees or less relative to an axis A-A extending through a center of the brake body 202 (shown in FIG. 2). In some cases, the outer surface 214 having the first taper 220 can comprise a conical shape or a frustoconical shape. In some cases, the outer surface 214 of the brake can further include a step 221 having a first surface 223.

In some instances, the brake further includes a collar 222 (e.g., a lock ring, etc.). The collar 222 is configured to connect to the proximal end 204 of the brake body 202. The collar 222 is further configured to independently rotate about the outer surface 214 of the proximal end 204 of the brake body 202. In other words, the collar 222 can rotate around the outer surface 214 of the brake body 202 even when the brake body 202 itself does not rotate.

In order to achieve independent rotation of the collar 222, the collar 222 has a second groove 224 on an inner surface 226 of the collar 222. The second groove 224 is configured to receive or engage with the ring 218. When the collar 222 is in an unlocked position or when the brake 200 is not attached to a suppressor 300 or adapter 400, the ring 218 is configured to float within the second groove 224. A width of the second groove 224 can be larger than a width of the ring 218 in order to allow the ring 218 to float within the second groove 224. When the collar 222 is in a locked position on the suppressor 300 or adapter 400, an upper surface 228 of the second groove 224 can engage with the ring 218 to prevent the collar 222 from rotating and to prevent the collar 222 from moving toward a proximal end 304 of the suppressor 300.

In some cases, the inner surface 226 of the collar 222 further includes one or more inner threads 230.

Turning to the suppressor 300, the suppressor 300 is an exemplary suppressor for a firearm and is not intended to limit the configuration of a suppressor that can be used with the proposed system 100. The suppressor 300 might have many different configurations from the one shown in FIGS. 1, 3, and 5. The firearm that the suppressor 300 attaches to might include, but is not limited to, a rifle, handgun, automatic firearm, semiautomatic firearm, or the like.

The suppressor 300 includes a suppressor body 302 having a proximal end 304 configured to attach to a barrel of a firearm and a distal end 306 opposite the proximal end 304 configured to attach to a brake (e.g., brake 200). The suppressor body 302 of the suppressor 300 may be cylindrical, square-shaped, conical, rectangular, and/or the like.

The suppressor 300 is configured to reduce the muzzle blast of a firearm caused when high-pressure gasses exit the barrel of the firearm. In order to reduce the muzzle blast of the firearm, the suppressor 300 creates a significantly larger volume than exists in the firearm barrel allowing high-pressure gas to expand within the suppressor 300 before the gas exits a distal end 306 of the suppressor 300 and/or before the gas exits through the one or more ports 208 or a distal end 206 of the brake 200. In order to create this larger volume, the suppressor 300 can additionally comprise a baffle system 308 (shown in FIG. 3) having one or more baffles 310*a* and 310*b* (collectively, baffles 310). The baffle system 308 shown in FIG. 3 is only part of the baffle system 308 of the suppressor 300. The suppressor body 302 at least partially surrounds the baffle system 308 or the one or more baffles 310. The size and configuration of the suppressor 300 and the size, number, and configuration of baffles 310 needed to effectively dissipate the high-pressure gases behind the projectile vary depending on a number of factors including without limitation the caliber and barrel length of the firearm as well as the type of ammunition or projectile used. Thus, the suppressor 300 can be larger or smaller and/or might have more or less baffles 310 than shown in FIG. 3. In some cases, the suppressor 300 might not have a baffle system 308 or one or more baffles 310.

In various embodiments, a distal end 306 of the suppressor 300 further includes an aperture 312. The aperture 312 can be configured to receive and/or engage with a proximal end 204 of the brake body 202.

In some cases, the distal end 306 of the suppressor further includes an inner surface 314 having a taper 316 (e.g., second taper 316). The second taper 316 might be angled at about 20 degrees or less relative to an axis B-B extending through a center of the suppressor body 302 (shown in FIG. 3). In some cases, the inner surface 314 having the second taper 316 can comprise a conical shape or a frustoconical shape.

The distal end 306 of the suppressor 300 can further include an upper portion 317 configured to engage with the first surface 223 of the step 221 of the brake 200.

In some cases, the suppressor body 302 can further include one or more outer threads 318 on an outer surface 320 of the distal end 306 of the suppressor body 302.

Figure 6:
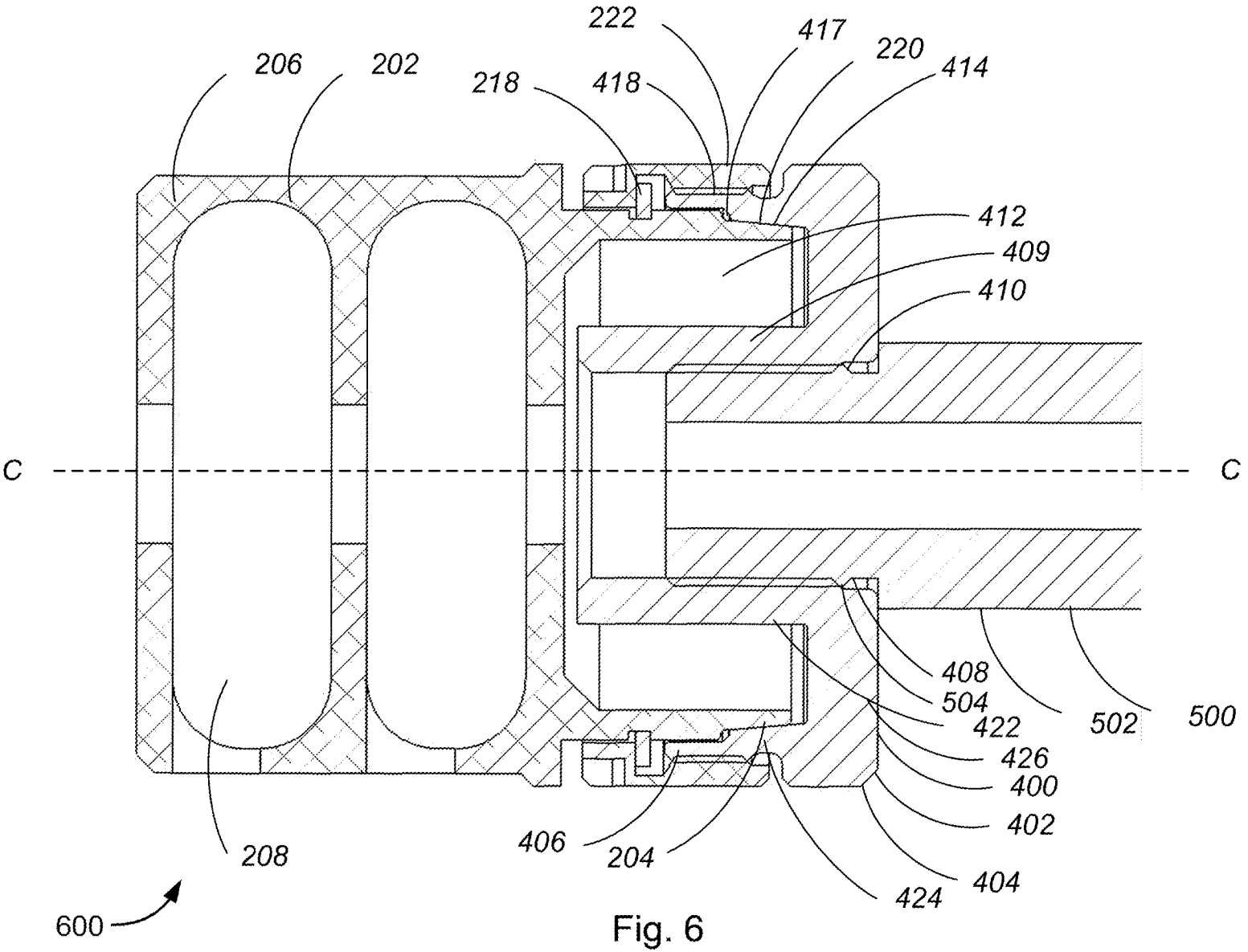
FIG. 6 is a side elevation cross sectional view of another embodiment of a system for a firearm having a brake and an adapter as disclosed herein.

FIG. 6 shows a side elevation cross-sectional view of a system 600 having a brake 200 and an adapter 400 for an end or barrel 502 of a firearm 500, in accordance with another embodiment of the disclosure. The adapter 400 shown in FIG. 6 is an exemplary adapter and is not intended to limit the configuration of an adapter 400 that can be used with the proposed system 600. The adapter 400 might have many different configurations from the one shown in FIG. 6. The firearm that the adapter 400 attaches to might include, but is not limited to, a rifle, handgun, automatic firearm, semiautomatic firearm, or the like.

The adapter 400 includes an adapter body 402 having a proximal end 404 configured to attach to a barrel 502 of a firearm 500 and a distal end 406 opposite the proximal end 404 configured to attach to a brake (e.g., brake 200). The adapter body 402 of the adapter 400 may be cylindrical, square-shaped, conical, rectangular, and/or the like.

The adapter 400 is configured to couple a brake (e.g., brake 200) to a barrel 502 of a firearm 500. The structure used to couple the brake 200 to the adapter 400 can be similar to and operate in a similar manner as the structure configured to couple the brake 200 to the suppressor 300. The adapter 400 comprises a first sidewall 422 coupled to a second sidewall 424 via a connecting wall 426.

In various embodiments, a first inner surface 408 of a first sidewall 422 of the adapter 400 comprises one or more inner threads 410 configured to be coupled to one or more outer threads 504 on a barrel 502 of the firearm 500. The adapter body 402 can be coupled to the firearm 500 by engaging the one or more inner threads 410 of the adapter 400 with the one or more outer threads 504 on the barrel 502 of the firearm 500.

In some instances, a distal end 406 of the adapter 400 further includes an aperture 412 defined by inner surfaces of the first sidewall 422, the second sidewall 424, and the connecting wall 426. The aperture 412 can be configured to receive and/or engage with a proximal end 204 of the brake body 202.

In some cases, the distal end 406 of the adapter 400 further includes a second inner surface 414 having a taper 416 (e.g., second taper 416 and/or similar to second taper 316 of the suppressor 300). The second taper 416 might be angled at about 20 degrees or less relative to an axis C-C extending through a center of the adapter body 402 (shown in FIG. 6). In some cases, the second inner surface 414 having the second taper 416 can comprise a conical shape or a frustoconical shape.

The distal end 406 of the adapter 400 can further include a step 417 configured to engage with the first surface 223 of the step 221 of the brake 200.

In some cases, the adapter body 402 can further include one or more outer threads 418 on an outer surface 420 of the second sidewall 424 of the distal end 406 of the adapter body 402.

Figure 7:
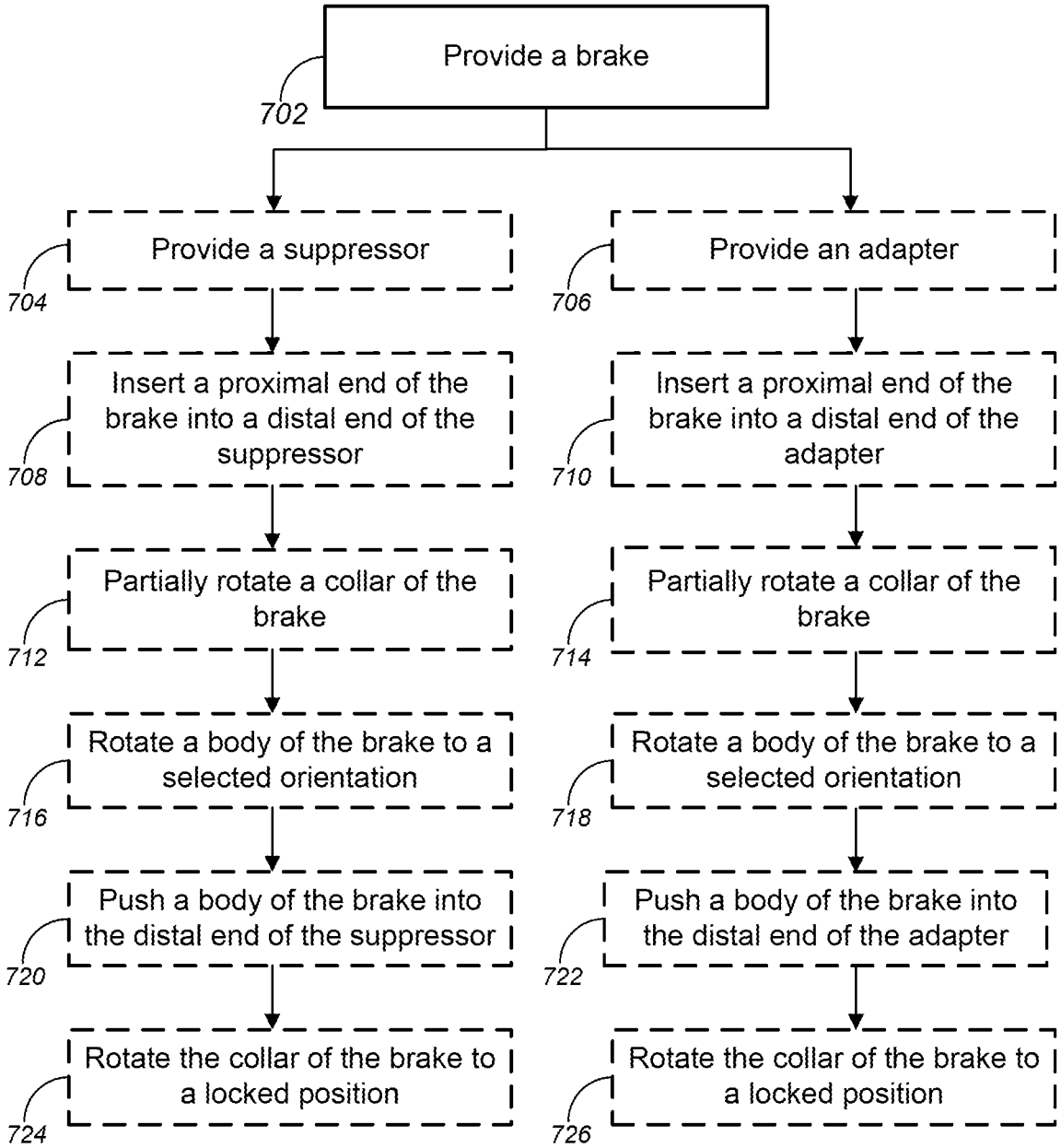
FIG. 7 is a flow diagram of a method of coupling the brake to the suppressor or the adapter.

In some examples, a method 700 of FIG. 7 might be used to attach brake 200 of FIGS. 1-6 to a suppressor 300 or an adapter 400. The method may, at block (e.g., manual operation) 702, include providing a brake (e.g., brake 200 of FIGS. 1-6). Next, the method, at optional block 704, can include providing a suppressor (e.g., suppressor 300 of FIGS. 1 and 3-5) or, at optional block 706, can include providing an adapter (e.g., adapter 400 of FIG. 6). In some cases, a proximal end (e.g., proximal end 304 or 404) the suppressor 300 and/or adapter 400 might be coupled to a firearm (e.g., firearm 500).

Next, at optional block 708 or at optional block 710, the method can include inserting a proximal end 204 of the brake body 202 into an aperture (e.g., aperture 312 or 412) of a distal end (e.g., distal end 306 or 406) of the suppressor body 302 or the adapter body 402. As the proximal end 204 of the brake body 202 is inserted into a distal end (e.g., distal end 306 or 406) of the suppressor body 302 or the adapter body 402, the outer surface 214 having the first taper 220 of the brake body 202 engages with the inner surface (e.g., inner surface 314 or 414) having the second taper (e.g., second taper 316 or 416) of the suppressor body 302 or the adapter body 402. The outer surface 214 having the first taper 220 might be smooth and the inner surface (e.g., inner surface 314 or 414) having the second taper (e.g., second taper 316 or 416) might be smooth to more easily engage the first taper 220 with the second taper (e.g., second taper 316 or 416).

Engaging the first taper 220 with the second taper (e.g., second taper 316 or 416) can align the one or more inner threads 230 of the collar 222 with the one or more outer threads (e.g., outer thread 318 or 418) of the suppressor body 302 or the adapter body 402. Next, at optional blocks 712 and 714, the collar 222 can be rotated independently of the brake body 202 to cause the one or more inner threads 230 of the collar 222 to begin to engage with the one or more outer threads (e.g., outer thread 318 or 418) of the suppressor body 302 or the adapter body 402. Rotation of the collar 222 can cause the first taper 220 to be drawn further within the second taper (e.g., taper 316 or 416) of the suppressor body 302 or adapter body 402. The collar 222 in these steps is only partially rotated or partially tightened (e.g., not fully rotated to a locked position) in order to allow a brake body 202 of the brake 200 to independently rotate within the distal end (e.g., distal end 306 or 406) of the suppressor 300 or the adapter 400. In some cases, optional blocks 712 and 714 can be skipped and rotation of the collar 222 can occur after optional blocks 716 and 718.

As the first taper 220 of the brake body 202 engages with the second taper (e.g., second taper 316 or 416) of the suppressor body 302 or the adapter body 402, the brake body 202 can be rotated independently of the collar 222 to a selected or desired orientation, direction, or position (at optional blocks 716 or 718). In some cases, the selected or desired orientation represents an orientation that reduces or optimally reduces a recoil of the firearm as one or more hot gases exit the brake body 202 through the distal end 206 of the brake body 202 and the one or more ports 208 of the brake body 202. In a non-limiting example, the brake body 202 can be oriented such that the one or more ports 208 are oriented to one or more sides relative to a barrel of the firearm instead of up or down relative to a barrel of the firearm.

Once the brake body 202 is rotated to the selected or desired position, direction, or orientation, a first force can be applied to the brake body 202 pushing the brake body 202 toward the proximal end (e.g., proximal end 304 or 404) of the suppressor 300 or adapter 400 at optional blocks 720 and 722. This first force causes the first taper 220 or a portion of the first taper 220 of the brake 200 to semi-permanently lock or wedge within the second taper (e.g., second taper 316 or 416) or a portion of the second taper (e.g., second taper 316 or 416) of the suppressor 300 or the adapter 400. In some cases, as the first force is being applied to the brake body 202, the first surface 223 of the step 221 can engage with the upper portion 217 of the suppressor 300 or the step 417 of the adapter 400 preventing the first taper 220 of the brake 200 from being inserted further into the second taper (e.g., second taper 316 or 416) of the suppressor 300 or the adapter 400.

Once the first taper 220 is wedged within the second taper (e.g., second taper 316 or 416) of the suppressor 300 or the adapter 400, the brake body 202 of the brake 200 is prevented from rotating. In order to disengage the first taper 220 of the brake 200 from the second taper (e.g., second taper 316 or 416) of the suppressor 300 or the adapter 400, a force can be applied (e.g., about perpendicular to a side) to a side of the brake body 202 and cause the first taper 220 to disengage from the second taper (e.g., second taper 316 or 416).

Once the first taper 220 is wedged within the second taper second taper (e.g., second taper 316 or 416) of the suppressor 300 or the adapter 400, the collar 222 of the brake body 202 can be independently rotated to a locked position without rotating the brake body 202. In some cases, when the collar 222 is in the locked position, an upper surface 228 of the second groove 224 is configured to engage with the ring 218 to prevent the collar 222 from rotating further toward a proximal end (e.g., proximal end 304 or 404) of the suppressor body 302 or the adapter body 402.

In some cases, when the first taper 220 of the brake 200 is wedged against the second taper (e.g., second taper 316 or 416) of the suppressor 300 or the adapter 400 and when the collar 222 is in the locked position, the first taper and second taper create a seal to prevent the escape of gases from the interface between the brake 200 and suppressor 300 or the adapter 400.

The method 700 can be performed in an opposite direction with some slight modifications discussed above to disengage the brake 200 from the suppressor 300 or the adapter.

Embodiments of the disclosure provide an improved firearm system for attaching a timeable brake (e.g., brake 200) to a suppressor (e.g., suppressor 300) or an adapter (e.g., adapter 400) for a firearm barrel. In some embodiments, according to the disclosure the disclosed system can substantially reduce a recoil of the firearm. In a non-limiting example, when the brake was attached to the suppressor a recoil of a firearm was reduced almost 60% versus bare muzzle. When only the suppressor was attached to the firearm, the recoil was reduced 32% versus bare muzzle. Thus, having the suppressor and brake is almost twice as effective to reduce a recoil as only having a suppressor. Further, attaching only the brake to a muzzle of the firearm reduced the recoil 64.8%. Thus, having the suppressor and brake is almost as effective to reduce a recoil as only having a brake. Table 1 below summarizes these improved features of the disclosed brake and suppressor.

TABLE 1

| Suppressor/muzzle device | % reduction in recoil compared to bare muzzle |
|---|---|
| TBAC suppressor without suppressor brake | 31.9% |
| TBAC suppressor with suppressor brake | 58.4% |
| High performing muzzle brake (not suppressed) | 64.8% |
| Suppressor from another competitor | 30.6% |

*Data from 16" 50 BMG bolt action shooting M33 ball ammunition

In some implementations, devices or systems disclosed herein can be utilized or installed using methods embodying aspects of the disclosure. Correspondingly, description herein of particular features or capabilities of a device or system is generally intended to inherently include disclosure of a method of using such features for intended purposes and of implementing such capabilities. Similarly, express discussion of any method of using a particular device or system, unless otherwise indicated or limited, is intended to inherently include disclosure, as embodiments of the invention, of the utilized features and implemented capabilities of such device or system.

As used herein, unless otherwise limited or defined, "or" indicates a non-exclusive list of components or operations that can be present in any variety of combinations, rather than an exclusive list of components that can be present only as alternatives to each other. For example, a list of "A, B, or C" indicates options of: A; B; C; A and B; A and C; B and C; and A, B, and C. Correspondingly, the term "or" as used herein is intended to indicate exclusive alternatives only when preceded by terms of exclusivity, such as "only one of," or "exactly one of." For example, a list of "only one of A, B, or C" indicates options of: A, but not B and C; B, but not A and C; and C, but not A and B. In contrast, a list preceded by "one or more" (and variations thereon) and including "or" to separate listed elements indicates options of one or more of any or all of the listed elements. For example, the phrases "one or more of A, B, or C" and "at least one of A, B, or C" indicate options of: one or more A; one or more B; one or more C; one or more A and one or more B; one or more B and one or more C; one or more A and one or more C; and one or more A, one or more B, and one or more C. Similarly, a list preceded by "a plurality of" (and variations thereon) and including "or" to separate listed elements indicates options of one or more of each of multiple of the listed elements. For example, the phrases "a plurality of A, B, or C" and "two or more of A, B, or C" indicate options of: one or more A and one or more B; one or more B and one or more C; one or more A and one or more C; and one or more A, one or more B, and one or more C.

The previous description of the disclosed embodiments is provided to enable any person skilled in the art to make or use the invention. Various modifications to these embodiments will be readily apparent to those skilled in the art, and the generic principles defined herein may be applied to other embodiments without departing from the spirit or scope of the invention. Thus, the invention is not intended to be limited to the embodiments shown herein but is to be accorded the widest scope consistent with the principles and novel features disclosed herein.

We claim:

1. A system for a firearm comprising:

a brake comprising:

a brake body having a proximal end;

the proximal end having an outer surface having a first taper;

a collar connected to the proximal end of the brake body, the collar configured to independently rotate around the proximal end of the brake body, and the collar having an inner surface having one or more inner threads;

a first groove on the outer surface of the proximal end of the brake body;

a ring engaged with the first groove on the outer surface of the proximal end of the brake body; and a second groove on the inner surface of the collar;

a suppressor comprising:

a suppressor body having a distal end;

the distal end comprising an aperture, an inner surface having a second taper, and an outer surface having one or more outer threads;

wherein the aperture of the distal end of the suppressor is configured to receive the proximal end of the brake and the first taper is configured receive the second taper;

wherein the one or more inner threads of the collar are configured to engage with the one or more outer threads of the suppressor;

wherein, when the brake body is oriented in a selected orientation with respect to the suppressor body, rotation of the collar to a locked position secures the brake body to the suppressor body; and wherein, when the collar is in an unlocked position the ring is configured to float within the second groove, and, when the collar is in the locked position, an upper surface of the second groove is configured to engage with the ring to prevent the collar from rotating.

2. The system of claim 1, wherein an angle of at least one of the first taper or the second taper is about 20 degrees or less.

3. The system of claim 1, wherein, when the brake body is oriented in a selected orientation, the brake body is configured to receive a force in toward a proximal end of the suppressor body opposite the distal end of the suppressor body to wedge at least a portion of the second taper and the first taper together to prevent rotation of the brake body with respect to the suppressor body.

4. The system of claim 3, wherein, when at least a portion of the first taper is wedged against at least a portion of the second taper and when the collar is in a locked position, the first taper and second taper create a seal.

5. The system of claim 1, wherein at least one of the inner surface having the first taper or the outer surface having the second taper comprises a conical shape or a frustoconical shape.

6. The system of claim 1, wherein at least one of the inner surface having the first taper or the outer surface having the second taper are smooth.

7. The system of claim 1, wherein, when the collar is in the locked position, the selected orientation of the brake is selected to reduce a recoil of the system when a proximal end of the suppressor body opposite the distal end of the suppressor body is attached to the firearm.

8. The system of claim 1, wherein the brake is a timeable brake.

9. The system of claim 1, wherein the brake further comprises:

one or more first ports on a first side of the brake body; and one or more second ports on a second side opposite the first side of the brake body.

10. The system of claim 1, wherein the suppressor further comprises:

a baffle system at least partially surrounded by the suppressor body, the baffle system comprising one or more baffles.

11. A brake comprising:

a brake body having a proximal end;

the proximal end having an outer surface having a first taper configured to engage with a second taper of a distal end of a suppressor or an adapter;

a collar connected to the proximal end of the brake body, the collar configured to independently rotate around the proximal end of the brake body, and the collar having an inner surface having one or more inner threads;

a first groove on the outer surface of the proximal end of the brake body;

a ring engaged with the first groove on the outer surface of the proximal end of the brake body; and a second groove on the inner surface of the collar;

wherein the one or more inner threads of the collar are configured to engage with one or more outer threads of at least one of the suppressor or the adapter;

wherein, when the brake body is oriented in a selected orientation with respect to the suppressor or the adapter, rotation of the collar to a locked position secures the brake body to the suppressor or the adapter; and wherein, when the collar is in an unlocked position the ring is configured to float within the second groove, and, when the collar is in the locked position, an upper surface of the second groove is configured to engage with the ring to prevent the collar from rotating.

12. The brake of claim 11, wherein an angle the first taper is about 20 degrees or less.

13. The brake of claim 11, wherein the outer surface having the second taper comprises a conical shape or a frustoconical shape.

14. The brake of claim 11, wherein the outer surface having the second taper is smooth.

15. The brake of claim 11, wherein the brake is a timeable brake.

16. The brake of claim 11, wherein the brake further comprises:

one or more first ports on a first side of the brake body; and one or more second ports on a second side opposite the first side of the brake body.

17. A method of manufacturing a system for a firearm, the method comprising:

forming a brake comprising:

a brake body having a proximal end;

the proximal end having an outer surface having a first taper configured to engage with a second taper of a distal end of a suppressor or an adapter;

a collar connected to the proximal end of the brake body, the collar configured to independently rotate around the proximal end of the brake body, and the collar having an inner surface having one or more inner threads;

a first groove on the outer surface of the proximal end of the brake body;

a ring engaged with the first groove on the outer surface of the proximal end of the brake body; and a second groove on the inner surface of the collar;

wherein the one or more inner threads of the collar are configured to engage with one or more outer threads of at least one of the suppressor or the adapter;

wherein, when the brake body is oriented in a selected orientation with respect to the suppressor or adapter, rotation of the collar to a locked position secures the brake body to the suppressor or the adapter; and wherein, when the collar is in an unlocked position the ring is configured to float within the second groove, and, when the collar is in the locked position, an upper surface of the second groove is configured to engage with the ring to prevent the collar from rotating.

18. The method of claim 17, further comprising:

forming a suppressor comprising:

a suppressor body having the distal end; and the distal end comprising an aperture, an inner surface having the second taper, and an outer surface having the one or more outer threads.

* * * * *